US012661549B1

(12) United States Patent
Bao

(10) Patent No.: US 12,661,549 B1
(45) Date of Patent: Jun. 23, 2026

(54) MULTI-FUNCTIONAL EXERCISING DEVICE

(71) Applicant: Zhejiang Yiyu Technology Co., Ltd., Jinhua (CN)

(72) Inventor: Hanyu Bao, Jinhua (CN)

(73) Assignee: Zhejiang Yiyu Technology Co., Ltd., Zhejiang (CN)

( * ) Notice: Subject to any disclaimer, the term of this patent is extended or adjusted under 35 U.S.C. 154(b) by 0 days.

(21) Appl. No.: 18/991,718

(22) Filed: Dec. 23, 2024

(51) Int. Cl.
*A63B 23/02* (2006.01)

(52) U.S. Cl.
CPC ..... *A63B 23/0211* (2013.01); *A63B 23/0216* (2013.01); *A63B 2210/50* (2013.01)

(58) Field of Classification Search
CPC ..... A63B 17/00; A63B 17/02; A63B 17/04; A63B 22/20; A63B 22/201; A63B 22/203; A63B 22/205; A63B 22/208; A63B 23/0205; A63B 23/0211; A63B 23/0216; A63B 23/0222; A63B 23/0227; A63B 2022/206; A63B 2210/50
See application file for complete search history.

(56) References Cited

U.S. PATENT DOCUMENTS

| | | | | |
|---|---|---|---|---|
| 5,279,531 | A * | 1/1994 | Jen-Huey | A63B 21/154 482/54 |
| 9,283,428 | B1 * | 3/2016 | Esrick | A63B 21/012 |
| 9,492,705 | B2 * | 11/2016 | Hong | A63B 21/00069 |
| 9,526,942 | B2 * | 12/2016 | Mills | A63B 21/4035 |
| 11,491,368 | B2 * | 11/2022 | Hao | A63B 23/1236 |
| 2014/0141949 | A1 * | 5/2014 | Mills | A63B 21/4045 482/140 |
| 2016/0067545 | A1 * | 3/2016 | Hong | A63B 21/0552 482/138 |
| 2023/0166154 | A1 * | 6/2023 | Hsu | A63B 21/4035 482/141 |

* cited by examiner

*Primary Examiner* — Joshua Lee

(57) ABSTRACT

A multi-functional exercising device is provided and includes an assembly and an engageable member. The assembly includes a base and two support members. The base is configured to be stably supported on a surface and defines two rails. The engageable member is detachably connectable with the assembly. Wherein the multi-functional exercising device has at least a first use state in which the assembly and the engageable member are able to be used independently from each other, and a second use state in which the engageable member is detachably connected to the support members and slidable with the support members relative to the base.

20 Claims, 6 Drawing Sheets

MULTI-FUNCTIONAL EXERCISING DEVICE

TECHNICAL FIELD

The present application relates to the technical field of exercising device, and in particular to a multi-functional exercising device for exercising human body such as abdominal muscles.

BACKGROUND

As people pay more and more attention to health, various kinds of exercising devices are widely used. Generally, an exercising device used in gyms includes a large frame with a handle at the upper end of the frame and a sliding pad for the user's knees to stand. The user can train abdominal muscles by pulling the sliding pad through the legs. However, the exercising device has large size and complex structure. Therefore, it is not suitable for household abdominal exercise, and it is too expensive.

Therefore, a new type of small abdominal wheel has appeared on the market. However, the abdominal wheel is apt to offset during use. Therefore, there is a threat of dumping during abdominal training, thus resulting in dangers. Further, the abdominal wheel has only one working mode and does not meet various of user's demands.

SUMMARY

Based on the above, an object of the present disclosure is to provide a multi-functional exercising device, which is stable and has multiple functions.

To achieve the above object, a multi-functional exercising device is provided and includes:

an assembly including:

a base, configured to be stably supported on a surface, the base defining two rails; and two support members, slidably engaged with the two rails respectively; and an engageable member, detachably connectable with the assembly;

wherein the multi-functional exercising device has at least a first use state in which the assembly and the engageable member are able to be used independently from each other, and a second use state in which the engageable member is detachably connected to the support members and slidable with the support members relative to the base.

With the above-described multi-functional exercising device, the base may be supported on the a surface and a large contracting surface is defined between the base and the surface, thus ensuring the multi-functional exercising device of the present disclosure being stable during exercising. When the engageable member is detachably connected to the support member, two elbows of the user can be supported on the engageable member and the knees/feet are positioned on a surface, such as the ground surface. The elbows drive the engageable member and the support member to move forward and backward relative to the base, and the user moves his/her body following the movement of the engageable member for abdominal exercise. In this use state, the two elbows move with the same speed. When the engageable member is removed from the support members, two elbows of the user can be supported on the two support members respectively and the knees/feet can be positioned on a surface, such as the ground surface. The elbows drive the support members to move back and forth relative to the base, and the user moves his/her body following the movement of the support members for abdominal exercise. When the engageable member is removed from the support members, two feet of the user can be supported on the two support members, and two palms can be positioned on a surface, such as the ground surface. The feet drive the support members to move back and forth relative to the base, and the user moves his/her body following the movement of the support members. In this use state, the speed of the two elbows or feet can be different. When the engageable member is removed from the support members, the engageable member can be supported on a surface such as the ground surface, the elbows or a single foot of the user can be supported on the engageable member and the knees/feet are supported on the surface for exercising. Therefore, the multi-functional exercising device of the present disclosure has two modes thus having multiple functions for satisfying various of demands.

In one of the embodiments, two rails of the base are parallel to each other.

In one of the embodiments, the base includes a main body and at least two sliders slidably connected on the main body, and each of the two support members is connected to one corresponding slider.

In one of the embodiments, the slider includes a frame body and at least one first roller rotatably connected to the frame body. The rail includes a positioning groove and at least one sliding groove. A part of the frame body forms a positioning block movably received in the positioning groove, and the first roller is rollably received in the sliding groove. A connecting bracket is formed on the bottom of the support member, which is configured to be connected to a supporting rod formed on the frame body.

In one of the embodiments, a damper is provided on the base, the damper is disposed between the slider and the main body, and the damper is configured to generate a damping force act on the slider during sliding.

In one of the embodiments, the damper includes a drawstring. One end of drawstring is connected to the slider, at least part of the drawstring is fixed relative to the main body, and the drawstring is an elastic rope.

In one of the embodiments, only one drawstring is provided, the damper further includes a guiding post and two guiding wheels arranged on the main body; along the sliding direction of the support member, the guiding post is separated by a certain distance from the guiding wheels, and the two guiding wheels are disposed abreast; two ends of the drawstring are connected to two sliders respectively, the drawstring successively winds on one of the guiding wheels, the guiding post and the other guide wheel.

In one of the embodiments, the main body is consisting of an upper plate and a lower plate connected to the bottom of the upper plate, the upper plate and the lower plate are connected to cooperatively define a receiving cavity therebetween, and the drawstring, the guiding post, and the guiding wheel are located in the receiving cavity.

In one of the embodiments, in the first use state of the multi-functional exercising device, the two support members are slidable independently from each other; and in the second use state of the multi-functional exercising device, the two support members and the engageable member are slidable together.

In one of the embodiments, a first plate and a second plate pivotally connected to one end of the first plate, thus the first plate and the second plate are folded or unfolded relative to each other.

In one of the embodiments, a slot is defined in an end of each of the first plate and the second plate, and a rotating shaft is formed each end of the slot, a hinge block is provided in the slots of the first plate and the second plate, and two hinged holes are defined in each end of the hinge block, the rotating shafts of the first plate are rotatably engaged in the hinged hole, and the rotating shafts of the second plate are rotatably engaged in the hinged hole.

In one of the embodiments, a plurality of positioning holes are defined in the base, the positioning holes are configured to fixedly engageable with two handles.

In one of the embodiments, two connecting holes are defined in two ends of the base respectively, and the connecting holes are configured to be connected to two pulling ropes respectively.

In one of the embodiments, a first pad is provided on the top of the support member, and the first pad is a soft cushion.

In one of the embodiments, at least one second roller is provided on the bottom of the engageable member.

In one of the embodiments, two mounting portions are provided on the bottom of the engageable member, and the mounting portions are configured to detachably accommodate two support members.

In one of the embodiments, a second pad is provided on the top of the engageable member, and the second pad is a soft cushion.

In one of the embodiments, the multi-functional exercising device further includes a support, which is configured to detachably connected to the bottom of the engageable member.

In one of the embodiments, the support is pyramidal, the support has a top end and the bottom portion having a larger cross section than that of the top end, and the bottom portion of the support is configured to detachably connected to the engageable member, and the top end of the support is used for support on a surface.

To achieve the above object, another multi-functional exercising device is provided and includes:

an assembly including:

a base, configured to be stably supported on a surface, the base defining two rails; and two support members, slidably engaged with the two rails respectively;

an engageable member, detachably connectable with the assembly; and a support, configured to be detachably connected to the bottom of the engageable member;

wherein the multi-functional exercising device has a first mode, a second mode, a third mode and a fourth mode; in the first mode, the engageable member is detachably connected to the assembly; in the second mode, the engageable member is removed from the support members, and the base is supported on a surface; in the third mode, the engageable member is removed from the support members, and the engageable member is slidably supported on a surface; in the fourth mode, the support is detachably connected to the bottom of the engageable member, and the support is supported on a surface.

Figure 1:
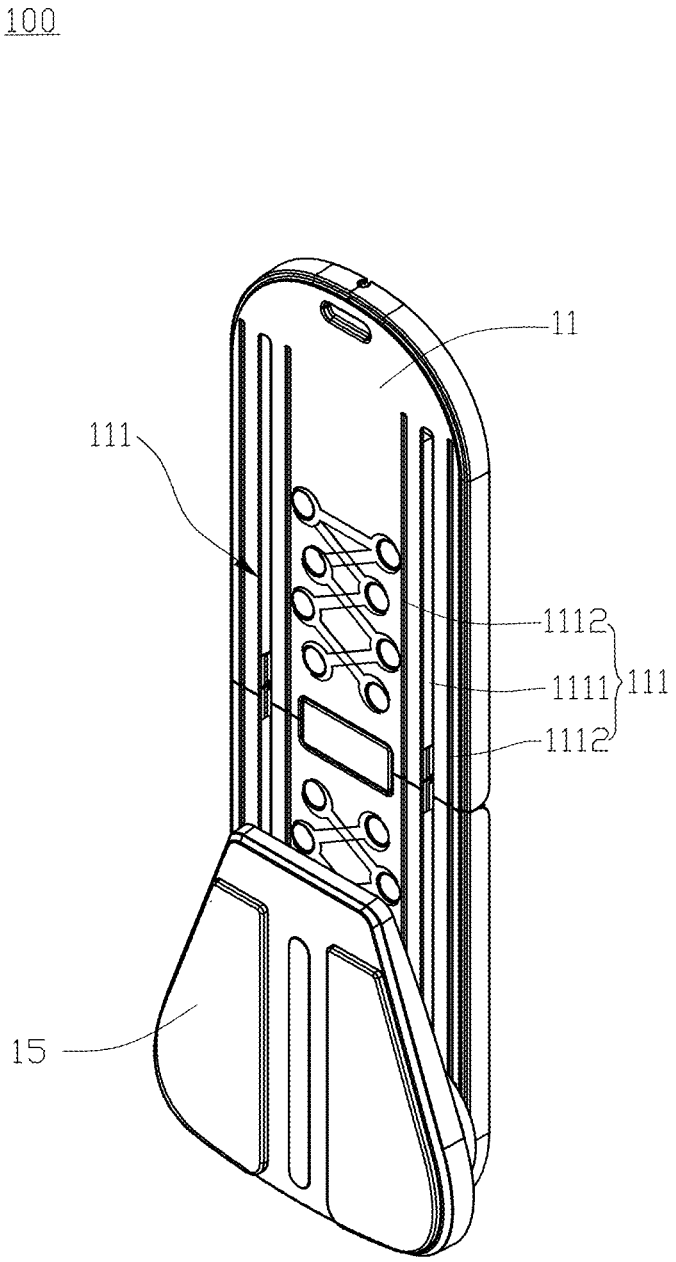
FIG. 1 is a schematic, perspective view of a multi-functional exercising device according to an embodiment of the present disclosure.

Reference numerals: multi-functional exercising device 100; base 11; rail 111; positioning groove 1111; sliding groove 1112; main body 113; first plate 1131; second plate 1133; slot 1135; rotating shaft 1136; hinge block 1137; hinged hole 1138; upper plate 1139; lower plate 1140; positioning hole 1143; two slider 115; frame body 1151; first roller 1153; supporting rod 1155; connecting hole 116; drawstring 117; guiding post 118; guiding wheel 119; support member 13; first pad 133; engageable member 15; second roller 152; supporting body 154; mounting portion 157; second pad 159; support 17.

DESCRIPTION OF EMBODIMENTS

The technical solution in the embodiments of the present application will be clearly and completely described below with reference to accompanying drawings in the embodiments of the present application. Obviously, the described embodiments are only a part of the embodiments of the present application, but not all of the embodiments. Based on the embodiments of the present application, all other embodiments obtained by those skilled in the art without any creative efforts fall within the protection scope of the present application.

In the description of the application, the oriental or positional relationships indicated by the terms "longitudinal", "transverse", "top", "bottom", "inner", "outer", "central", "axial", "radial", "circumferential" and the like are only intended to facilitate the description of the present application and simplify the description based on oriental or positional relationships shown in the accompanying drawings, not to indicate or imply that the apparatus or element referred must have a specific orientation, is constructed and operated in a specific orientation, and therefore cannot be understood as a limitation of the present application. Additionally, the terms "first", "second", "third" are only intended to facilitate the description, not to be understood to indicate or imply the importance thereof.

In the description of the application, it should be noted that unless otherwise specified and limited, the terms "assembled", "joined", "connected" should be explained in a broad scope, it may be fixedly connected to another element, detachably connected to another element, integrally connected to another element, mechanically connected to another element, electrically connected to anther element, directly connected to another element, indirectly connected to another element through one or multiple intermediate elements, or internal cavity of two elements communicated with each other. The specific meanings of all technical and scientific terms used in the specification can be specifically understood by persons of ordinary skill in the art.

A technical proposal of the embodiment of the application is described accompanying the drawings.

FIGS. 1 to 7 show a multi-functional exercising device 100 of at least one embodiment of the present application.

The multi-functional exercising device 100 of the present embodiment may be used to train human body such as the abdominal muscles.

Figure 2:
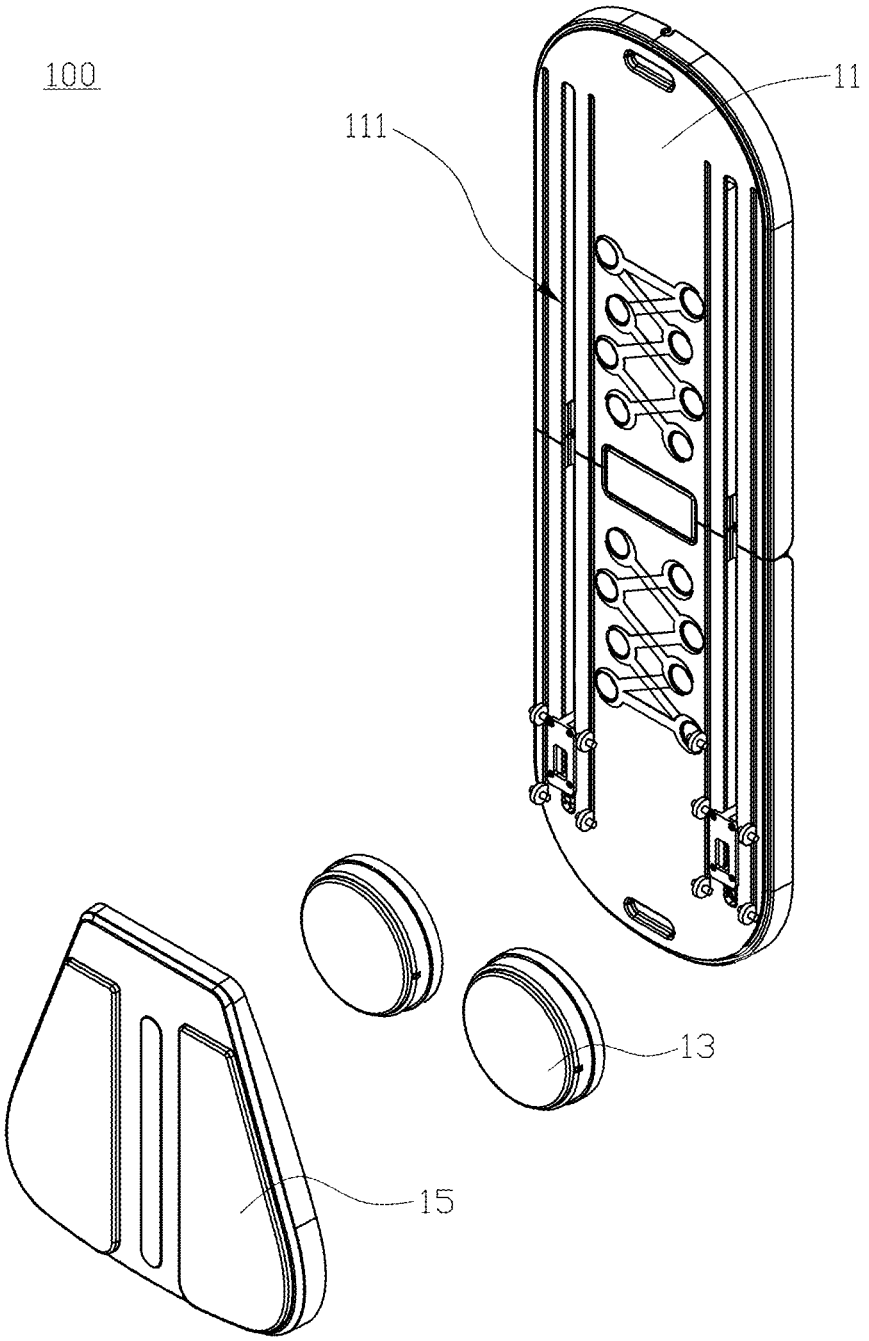
FIG. 2 is a partially exploded view of the multi-functional exercising device shown in FIG. 1.
Figure 3:
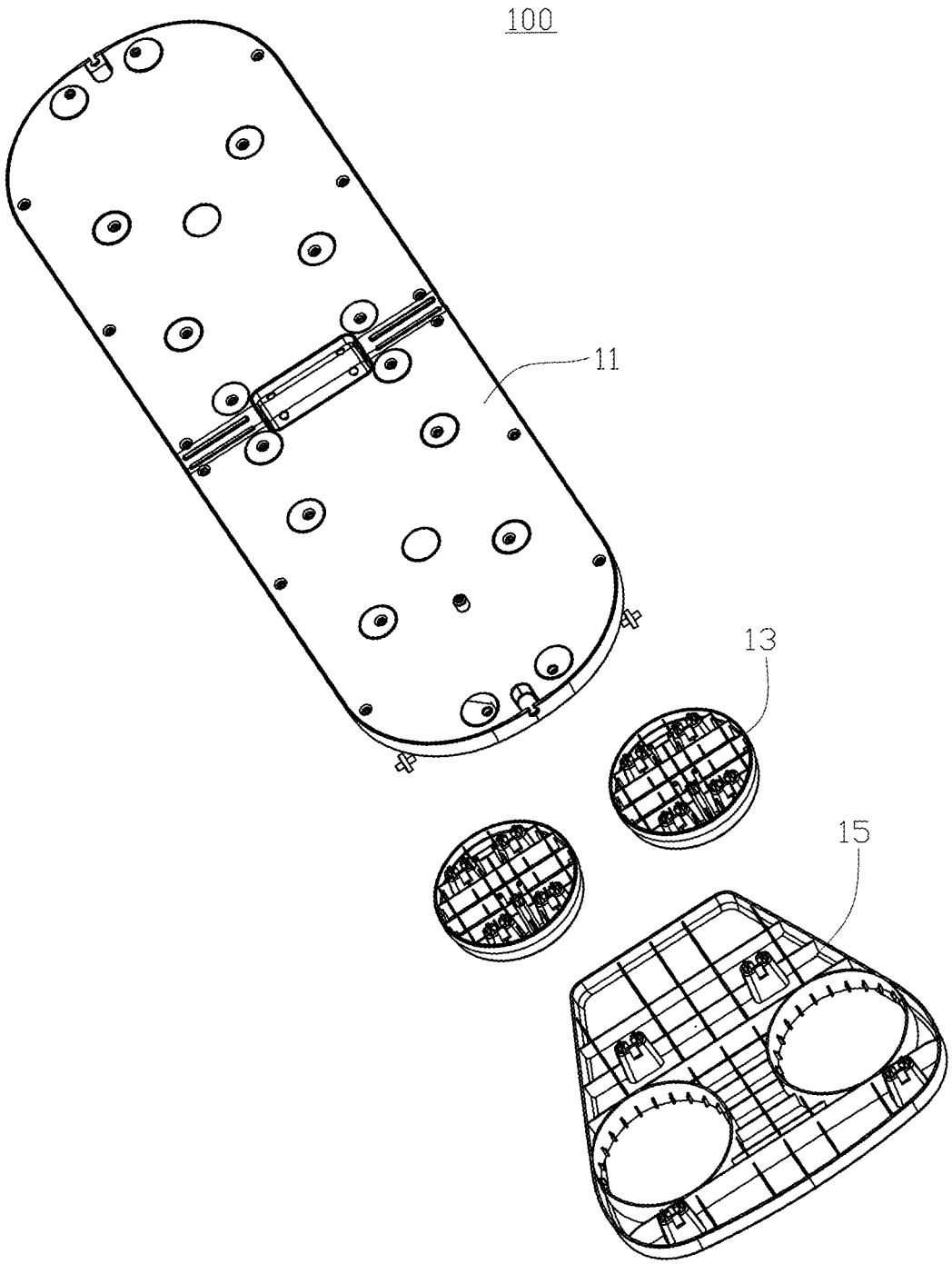
FIG. 3 illustrates the multi-functional exercising device shown in FIG. 2 from another aspect.

In this embodiment, referring to FIGS. 1 to 3, the multi-functional exercising device 100 includes an assembly and an engageable member 15. The assembly includes a base 11 and two support members 13. The base 11 is configured to be stably supported on a surface such as the ground surface. Two rails 111 are defined on the base 11, and the two support members 13 are slidably engaged with the two rails 111 respectively. The engageable member 15 is detachably connectable with the assembly. The multi-functional exercising device 100 has at least a first use state and a second use state. In the first use state, the assembly and the engageable member 15 are able to be used independently from each other. In the second use state, the engageable member 15 is detachably connected to the support members 13 and slidable with the support members 13 relative to the base 11. Specifically, the engageable member 15 is detachably connectable with the two support members 13. Specifically, in another embodiment, the multi-functional exercising device 100 may include more than two support members 13, and there are more than two rails 111 correspondingly.

With the above-described multi-functional exercising device, the base 11 may be supported on the a surface and a large contracting surface is defined between the base 11 and the surface, thus ensuring the multi-functional exercising device of the present disclosure being stable during exercising. When the engageable member 15 is detachably connected to the support members 13, two elbows of the user can be supported on the engageable member 15 and the knees/feet are positioned on a surface such as the ground surface. The elbows drive the engageable member 15 and the support member 13 to move forward and backward relative to the base 11, and the user moves his/her body following the movement of the engageable member 15 for abdominal exercise. In this use state, the two elbows move with the same speed. When the engageable member 15 is removed from the support members 13, two elbows of the user can be supported on the two support members 13 respectively and the knees/feet can be positioned on a surface such as the ground surface. The elbows drive the support members 13 to move back and forth relative to the base 11, and the user moves his/her body following the movement of the support members 13 for abdominal exercise. When the engageable member 15 is removed from the support members 13, two feet of the user can be supported on the two support members 13, and two palms can be positioned on a surface such as the ground surface. The feet drive the support members 13 to move back and forth relative to the base 11, and the user moves his/her body following the movement of the support members 13. In this use state, the speed of the two elbows or feet can be different. When the engageable member 15 is removed from the support members 13, the engageable member 15 can be supported on a surface such as the ground surface, the elbows of the user can be supported on the engageable member 15 and the knees/feet are supported on the surface for exercising, or a single foot of the user can be supported on the engageable member 15 and the other foot is supported on the surface for exercising. Therefore, the multi-functional exercising device of the present disclosure has two modes thus having multiple functions for satisfying various of demands.

In this embodiment, the two rails 111 of base 11 are parallel to each other. It is understood that, in another embodiment, the two rails 111 may also be inclined to each other.

Figure 4:
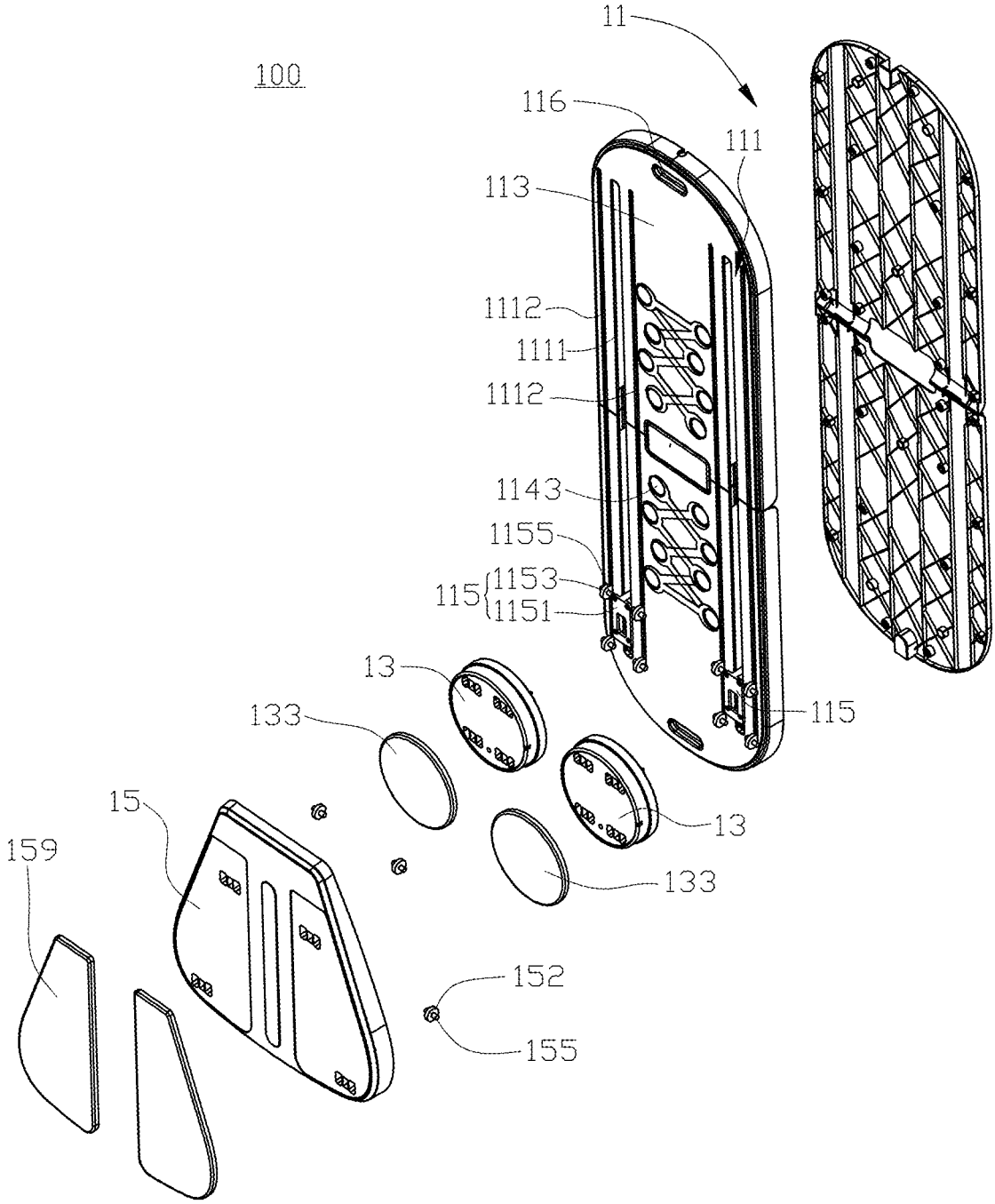
FIG. 4 is an exploded view of the multi-functional exercising device shown in FIG. 1.
Figure 5:
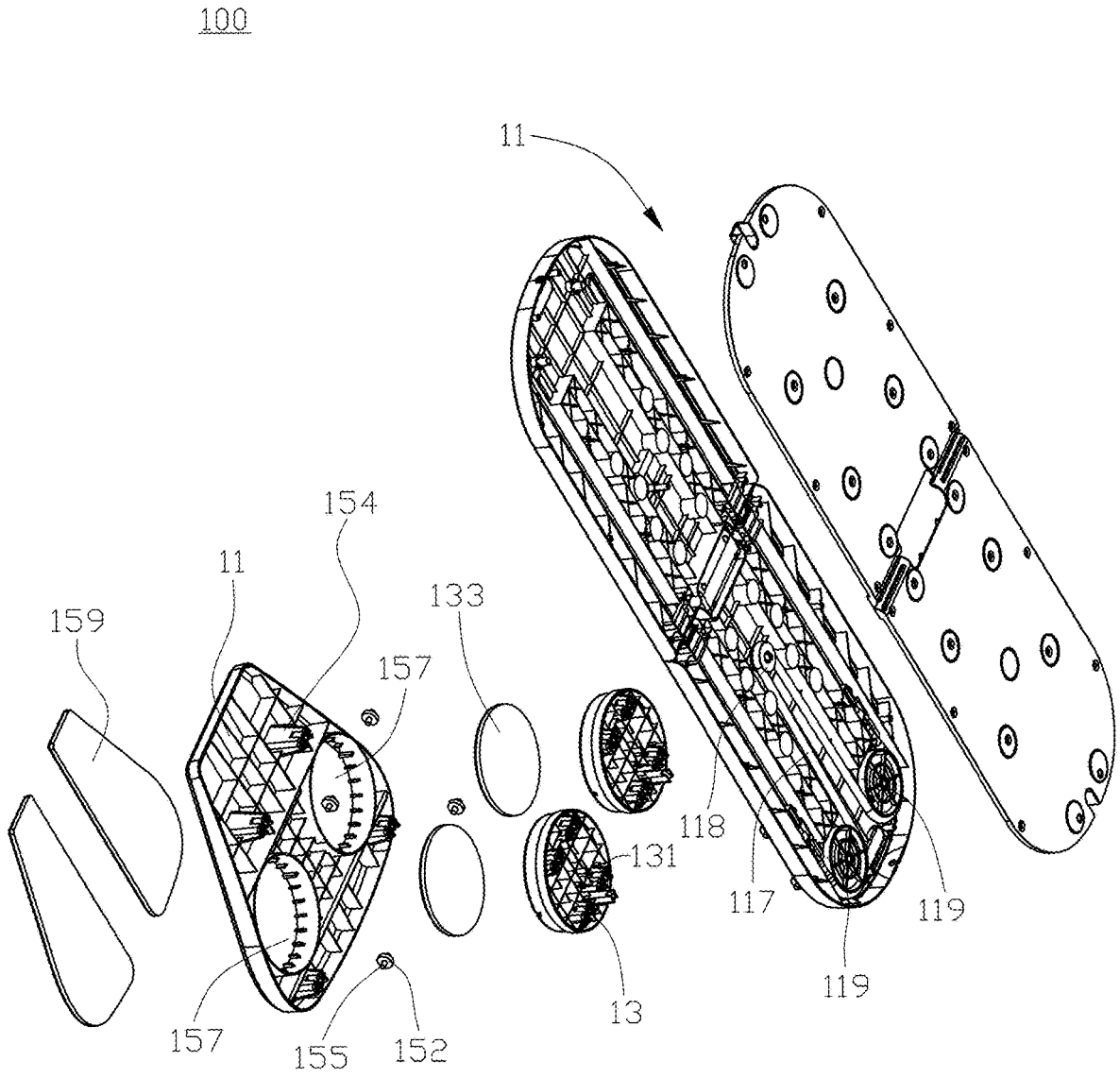
FIG. 5 illustrates the multi-functional exercising device shown in FIG. 4 from another aspect.

In this embodiment, referring to FIG. 4 and FIG. 5, the base 11 includes a main body 113 and two sliders 115 slidably connected on the main body 113. The rails 111 are defined on the main body 113, and the two sliders 115 are slidably engaged with the two rails 111 respectively. The two support members 13 are connected to the two sliders 115 respectively. It is understood that the slider 115 may be more than two, and each support member 13 may be connected to two or more sliders 115.

More specifically, the slider 115 includes a frame body 1151 and at least one first roller 1153 rotatably connected to the frame body 1151. The rail 111 includes a positioning groove 1111 and at least one sliding groove 1112. A part of the frame body 1151 forms a positioning block movably received in the positioning rail 1111, and the at least one first roller 1153 is rollably received in each sliding groove 1112. A connecting bracket 131 is formed on the bottom of the support member 13, which is configured to be connected to a supporting rod 1155 formed on the frame body 1151. In this embodiment, each rail 111 includes two sliding grooves 1112, and the positioning groove 1111 is parallel to the sliding grooves 1112. In this embodiment, each slider 115 includes four first rollers 1153, and two first rollers 1153 are rollably received in each sliding groove 1112.

Specifically, a damper is provided on the base 11, and the damper is disposed between the slider 115 and the main body 113. The damper is configured to generate a damping force act on the slider 115 during sliding. More specifically, in the embodiment shown in FIG. 5, the damper includes at least one drawstring 117. At least one end of drawstring 117 is connected to the slider 115, and at least part of the drawstring 117 is fixed relative to the main body 113. The drawstring 117 is an elastic rope, such as elastic band, a spring, etc. When the user pushes the support member 13 to slide from a first end to an opposite second end of the base 11, an elastic force of drawstring 117 resists the movement of the support member 13, thereby improving the exercise effect. Also, when the support member 13 slides from the second end to the first end of the base 11, the clastic force of the drawstring 117 helps the support member 13 returns the first end, thus making abdominal curl exercise be easy especially for beginners.

More specifically, as shown in FIG. 5, the damper further includes a guiding post 118 and two guiding wheels 119 arranged on the main body 113, and only one drawstring 117 is provided. Along the sliding direction of the support member 13, the guiding post 118 is separated by a certain distance from the guiding wheels 119, and the two guiding wheels 119 are disposed abreast. Two ends of the drawstring 117 are connected to two sliders 115 respectively. The drawstring 117 successively winds on one of the guiding wheels 119, the guiding post 118 and the other guide wheel 119. Specifically, the two guiding wheels 119 are disposed adjacent to an end of the main body 113, and the guiding post 118 is disposed adjacent to the middle portion of the main body 113. It is understood that, in an alternative embodiment, the damper may include two drawstrings 117, one end of each drawstring 117 is connected to one of the two sliders 115 and the other end of each drawstring 117 is fixed to the main body 113. It is understood that the damper may include a magnet disposed on the base 11 and a metal member disposed on the support members 13, and a magnetic force between the magnet and the meatal member performs as the damping force.

Figure 6:
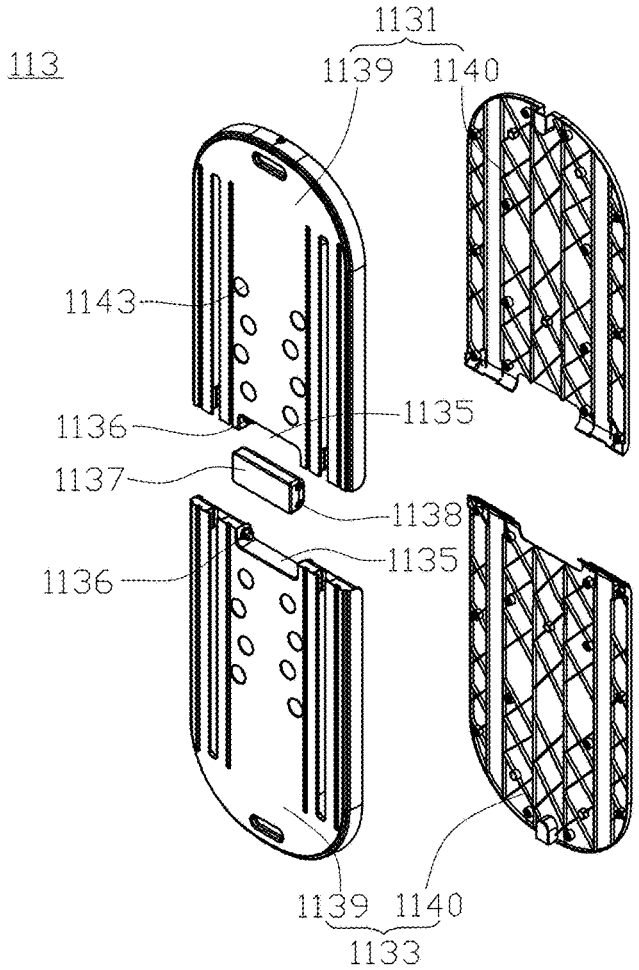
FIG. 6 is an exploded view of the main body of the multi-functional exercising device shown in FIG. 4.

Specifically, referring to FIG. 6, the main body 113 includes a first plate 1131 and a second plate 1133 pivotally connected to one end of the first plate 1131. In this embodiment, the second plate 1133 may be rotated with an angle of up to 180° relative to the first plate 1131, thereby folding the first plate 1131 and the second plate 1133 to facilitate the storage of the multi-functional exercising device 100. When the user trains, the first plate 1131 and the second plate 1133 may be unfolded into the state as shown in FIG. 1. More specifically, a slot 1135 is defined in an end of each of the first plate 1131 and the second plate 1133, and a rotating shaft 1136 is formed each end of the slot 1135. A hinge block 1137 is provided in the slots 1135 of the first plate 1131 and the second plate 1133, and two hinged holes 1138 are defined in each end of the hinge block 1137. The rotating shafts 1136 of the first plate 1131 are rotatably engaged in the hinged hole 1138, and the rotating shafts 1136 of the second plate 1133 are rotatably engaged in the hinged hole 1138. The main body 113 may be folded or unfolded by rotating the first plate 1131 or by rotating the second plate 1133. It is understood that the first plate 1131 and the second plate 1133 may be rotatably connected by other structures, for example, a rotating shaft may be formed on one of the first plate 1131 and the second plate 1133, and a hinged hole for rotatably engaged with rotating shaft may be defined in the other. Alternatively, the main body 113 may also be designed to be an integral one, and the first plate 1131 and the second plate 1133 are fixed relative to each other.

Specifically, each of the first plate 1131 and the second plate 1133 may be consisting of an upper plate 1139 and a lower plate 1140 connected to the bottom of the upper plate 1139. The upper plate 1139 and the lower plate 1140 are connected to cooperatively define a receiving cavity therebetween. More specifically, the drawstring 117, the guiding post 118, and the guiding wheel 119 are located in the receiving cavity. When the main body 113 is non-foldable, the main body 113 is consisting of one upper plate 1139 and one lower plate 1140.

Specifically, a plurality of positioning holes 1143 are defined in the main body 113 of the base 11. The positioning holes 1143 are configured to fixedly engageable with accessories, such as two handles (not shown). The handles may be connected to a pulling rope (not shown) connected to the base 11, and the user may grip the handles and pull the pulling rope to exercise arm muscles. Also, when the handles are engaged in the positioning holes 1143, two hands of the user can hold the handles and the feet of the user can be supported on the ground for perform push-up exercising.

Specifically, two connecting holes 116 are defined in two ends of the base 11 respectively, and the connecting holes 116 are configured to be connected to two pulling ropes (not shown) respectively. The user can pull two handles connected to an end of the two pulling ropes to exercise the hand muscles.

In this embodiment, a first pad 133 is provided on the top of the support member 13. The first pad 133 is a soft cushion, which can be made of soft materials, such as rubber, silicone, fibrous fabric or sponge. When the elbow or feet is supported on the support member 13, the user feels comfortable for the first pad 133 is soft.

Specifically, the support member 13 is circular. It can be understood that the support member 13 can also be rectangular, triangular or other shapes.

In this embodiment, at least one second roller 152 is provided on the bottom of the engageable member 15. The at least one second roller 152 of the engageable member 15 can roll on a surface such as the ground surface. In use, the elbows can be supported on the engageable member 15, or one foot can be supported on the engageable member 15. The elbows or the foot drive the engageable member 15 to move back and forth on the surface, and the user moves his/her body following the movement of the engageable member 15 for exercise. Specifically, the engageable member 15 forms a supporting body 154 at the bottom thereof, and the second roller 152 is rotatably connected to the supporting body 154 via a supporting shaft 155. In this embodiment, four second rollers 152 are provided on the engageable member 15. It is understood that the number of the second roller 152 may be two, three or more than four.

Specifically, two mounting portions 157 are formed on the bottom of the engageable member 15, and the mounting portions 157 are configured to detachably accommodate the two support members 13. In this embodiment, the mounting portion 157 has a shape the same as a shaped of the outer profile of the support member 13. For example, in this embodiment, the mounting portion 157 is circular.

Specifically, a second pad 159 is provided on the top of the engageable member 15. The second pad 159 is a soft cushion, which can be made of soft materials, such as rubber, silicone, fibrous fabric or sponge. When the elbow is supported on the engageable member 15, the user feels comfortable for the second pad 159 is soft.

Specifically, the engageable member 15 may be generally trapezoidal. Alternatively, the engageable member 15 may be rectangular, triangular or other shapes.

Figure 7:
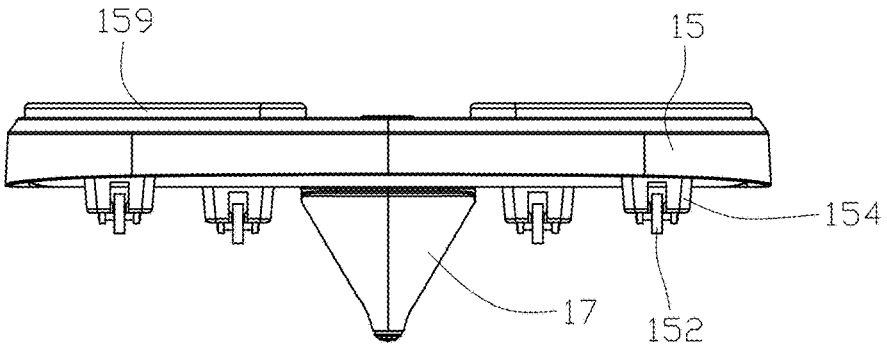
FIG. 7 is a side plan view of the engageable member connected with a support of the multi-functional exercising device shown in FIG. 1.

In this embodiment, referring to FIG. 7, the multi-functional exercising device 100 further includes a support 17, which is configured to detachably connected to the bottom of the engageable member 15. When the support 17 is assembled on the bottom of the engageable member 15, the support 17 can be supported on a surface such as the ground surface, and two elbows of the user can be supported on the engageable member 15, thereby a plank exercise being performed. When the engageable member 15 is connected to the support member 13 or the engageable member 15 is supported on a surface, the support 17 is removed from the bottom of the engageable member 15.

Specifically, the support 17 may be pyramidal, for example, tetrapyramidal. the support 17 has a top end and the bottom portion having a larger cross section than that of the top end. The bottom portion of the support 17 is configured to detachably connected to the engageable member 15, and the top of the support 17 is used for supporting on a surface. Furthermore, when the support 17 is connected to the engageable member 15, the support 17 is positioned between the two mounting portions 157. Specifically, the bottom of the support 17 is provided with a plurality of protruding dots to increase friction between the support 17 and a surface.

The multi-functional exercising device 100 of the present disclosure includes a first mode, a second mode, a third mode, a fourth mode, a fifth mode and a sixth mode.

In the first mode, the engageable member 15 is detachably connected to the support members 13. In this state, two elbows of the user can be supported on the engageable member 15 and the knees/feet are positioned on a surface such as the ground surface. The elbows drive the engageable member 15 and the support member 13 to move forward and backward relative to the base 11, and the user moves his/her body following the movement of the engageable member 15 for abdominal exercise.

In the second mode, the engageable member 15 is removed from the support members 13, and the base 11 is supported on a surface such as the ground surface. In this state, two elbows of the user can be supported on the two support members 13 respectively and the knees/feet are positioned on a surface such as the ground surface. The elbows drive the support members 13 to move back and forth relative to the base 11, and the user moves his/her body following the movement of the support members 13 for abdominal exercise. Also, in this state, two feet of the user can be supported on the two support members 13, and two palms are positioned on a surface such as the ground surface. The feet drive the support members 13 to move back and forth relative to the base 11, and the user moves his/her body following the movement of the support members 13 for exercising like climbing mountains.

In the third mode, the engageable member 15 is slidably supported on the a surface such as the ground surface via the second roller 152. In this state, the elbows of the user can be supported on the engageable member 15 and the knees/feet are supported on a surface such as the ground surface. The elbows drive the engageable member 15 to move back and forth on the surface, and the user moves his/her body following the movement of the engageable member 15 for abdominal exercise. Also, in this state, one single foot can be supported on the engageable member 15, and the other foot can be supported on a surface such as the ground surface. The foot supported on the engageable member 15 drives the engageable member 15 to move on the surface, and the user moves his/her body following the movement of the engageable member 15 for exercising. The engageable member 15 is small to facilitate to be taken along, thus the user can exercise anywhere.

In the fourth mode, the support 17 is detachably connected to the bottom of the engageable member 15, and the support 17 is supported on the ground. In this state, the elbows of the user can be supported on the engageable member 15, the feet of the user can be supported on the ground. The user keeps the body stable for performing plank exercising.

In the fifth mode, the two connecting holes 116 of the base 11 are detachably connected with two pulling ropes (not shown) respectively. In this state, the user grips the handles (not shown) of the end of the pulling ropes to exercise the hand muscles.

In the sixth mode, the positioning holes 1143 of the base 11 is detachably connected to two handles (not shown). In this state, two hands of the user can hold the handles and the feet of the user can be supported on a surface such as the ground surface for perform push-up exercising.

The above merely describes preferred embodiments of the present application without intention to limit the scope of the present application. Although the present application has been described in detail with reference to the foregoing embodiments, for those skilled in the art, the technical solutions described in the foregoing embodiments can still be modified, or some of the technical features can be equally replaced. Any modifications, equivalent replacements, improvements, and etc. made within the spirit and principle of the present application should be within the scope of the present application.

What is claimed is:

1. A multi-functional exercising device, comprising:

an assembly comprising:

a base, configured to be stably supported on a surface, the base defining two rails; and two support members, slidably connected to engage with the two rails respectively; and an engageable member, detachably connectable with the assembly, the number of the engageable member being only one;

wherein the multi-functional exercising device has at least a first use state in which the assembly and the engageable member are able to be used independently from each other, and a second use state in which the single engageable member is detachably and slidably connected to both of the two support members and slidable with the two support members relative to the base to enable the engageable member and the two support members to slide together.

2. The multi-functional exercising device of claim 1, wherein the two rails of the base are parallel to each other.

3. The multi-functional exercising device of claim 1, wherein the base comprises a main body and two sliders slidably connected on the main body, and each of the two support members is connected to one corresponding slider.

4. The multi-functional exercising device of claim 3, wherein each of the two sliders comprises a frame body and at least one first roller rotatably connected to the frame body, each of the two rails comprises a positioning groove and at least one sliding groove, a part of the frame body forms a positioning block movably received in the positioning groove, and the at least one first roller is rollably received in the sliding groove, a connecting bracket is formed on the bottom of each of the two support members, which is configured to be connected to a supporting rod formed on the frame body.

5. The multi-functional exercising device of claim 3, wherein a damper is provided on the base, the damper is disposed between at least one of the two sliders and the main body, and the damper is configured to generate a damping force act on the slider during sliding.

6. The multi-functional exercising device of claim 5, wherein the damper comprises at least one drawstring, at least one end of the drawstring is connected to the at least one of the two sliders, at least part of the drawstring is fixed relative to the main body, and the drawstring is an elastic rope.

7. The multi-functional exercising device of claim 6, wherein only one drawstring is provided, the damper further comprises a guiding post and two guiding wheels arranged on the main body; along a direction parallel to a sliding direction of the two support members, the guiding post is separated by a certain distance from the guiding wheels, and the two guiding wheels are disposed abreast; two ends of the drawstring are connected to the two sliders respectively, the drawstring successively winds on one of the guiding wheels, the guiding post and the other guiding wheel.

8. The multi-functional exercising device of claim 7, wherein the main body consists of an upper plate and a lower plate connected to a bottom of the upper plate, the upper plate and the lower plate are connected to cooperatively define a receiving cavity therebetween, and the drawstring, the guiding post, and the two guiding wheels are located in the receiving cavity.

9. The multi-functional exercising device of claim 3, wherein the main body comprises a first plate and a second plate pivotally connected to one end of the first plate, thus the first plate and the second plate are folded or unfolded relative to each other; when the first plate is connected to the second plate, the two rails are spaced in a certain distance in a direction perpendicular to the two rails, and sliding trajectorys of the two support members are spaced from each other and parallel to each other.

10. The multi-functional exercising device of claim 9, wherein a slot is defined in an end of each of the first plate and the second plate, two rotating shafts are formed in the slot with the two rotating shafts disposed at two ends of the slot respectively, a hinge block is provided in the slots of the first plate and the second plate, and two hinged holes are defined in each end of the hinge block, the two rotating shafts of the first plate are pivotally engaged in two of the hinged holes of the hinge block, and the two rotating shafts of the second plate are rotatably engaged in two of the hinged holes of the hinge block.

11. The multi-functional exercising device of claim 1, wherein in the first use state of the multi-functional exercising device, the two support members are slidable independently from each other; and in the second use state of the multi-functional exercising device, the two support members and the engageable member are slidable together.

12. The multi-functional exercising device of claim 1, wherein a first pad is provided on a top of the each of the two support members, and the first pad is a soft cushion.

13. The multi-functional exercising device of claim 1, wherein at least one second roller is provided on a bottom of the engageable member.

14. The multi-functional exercising device of claim 1, wherein two mounting portions are provided on a bottom of the engageable member, and the two mounting portions are configured to detachably accommodate the two support members.

15. The multi-functional exercising device of claim 1, wherein a second pad is provided on a top of the engageable member, and the second pad is a soft cushion.

16. The multi-functional exercising device of claim 1, wherein the multi-functional exercising device further comprises a support, which is configured to detachably connected to a bottom of the engageable member.

17. The multi-functional exercising device of claim 16, wherein the support is pyramidal, the support has a top end and a bottom portion having a larger cross section than that of the top end, and the bottom portion of the support is configured to detachably connect to the engageable member, and the top end of the support is used for support on a surface.

18. A multi-functional exercising device, comprising:

an assembly comprising:

a base, configured to be stably supported on a surface, the base defining two rails; and two support members, slidably engaged with the two rails respectively;

an engageable member, detachably connectable with the assembly; and a support, configured to be detachably connected to a bottom of the engageable member;

wherein the multi-functional exercising device has a first mode, a second mode, a third mode and a fourth mode; in the first mode, the engageable member is detachably connected to the assembly; in the second mode, the engageable member is removed from the support members, and the base is supported on a surface; in the third mode, the engageable member is removed from the support members, and the engageable member is slidably supported on a surface; in the fourth mode, the support is detachably connected to the bottom of the engageable member, and the support is supported on a surface.

19. A multi-functional exercising device, comprising:

an assembly comprising:

a base, configured to be stably supported on a surface, the base defining two rails, the base comprising a main body and two sliders slidably connected on the main body, and each of the two support members connected to one corresponding slider; and two support members, slidably connected to engage with the two rails respectively;

an engageable member, detachably connectable with the assembly; and a damper, provided on the base, wherein the damper is disposed between at least one of the two sliders and the main body, the damper is configured to generate a damping force act on the at least one of the two sliders during sliding, the damper comprises only one drawstring, the drawstring is an elastic rope, the damper further comprises a guiding post and two guiding wheels arranged on the main body; along a direction parallel to a sliding direction of the two support members, the guiding post is separated by a certain distance from the guiding wheels, and the two guiding wheels are disposed abreast; two ends of the drawstring are connected to two sliders respectively, the drawstring successively winds on one of the guiding wheels, the guiding post and the other guiding wheel;

wherein the multi-functional exercising device has at least a first use state in which the assembly and the engageable member are able to be used independently from each other, and a second use state in which the engageable member is detachably and slidably connected to the support members and slidable with the support members relative to the base.

20. A multi-functional exercising device, comprising:

an assembly comprising:

a base, configured to be stably supported on a surface, the base defining two rails; and two support members, slidably connected to engage with the two rails respectively;

an engageable member, detachably connectable with the assembly; and a support, configured to detachably connected to a bottom of the engageable member, wherein the support is pyramidal, the support has a top end and a bottom portion having a larger cross section than that of the top end, and the bottom portion of the support is configured to detachably connect to the engageable member, and the top end of the support is used for support on a surface;

wherein the multi-functional exercising device has at least a first use state in which the assembly and the engageable member are able to be used independently from each other, and a second use state in which the engageable member is detachably and slidably connected to the support members and slidable with the support members relative to the base.

* * * * *